United States Patent [19]

Taft et al.

[11] 4,416,245

[45] Nov. 22, 1983

[54] APPARATUS FOR DISTRIBUTING ELECTRICAL SIGNALS

[75] Inventors: Darwin O. Taft, Bainbridge; Howard E. Van Siclen, Jr., Unadilla, both of N.Y.

[73] Assignee: The Bendix Corporation, Southfield, Mich.

[21] Appl. No.: 382,065

[22] Filed: May 26, 1982

[51] Int. Cl.[3] ..... F02P 1/00

[52] U.S. Cl. ..... 123/613; 123/616; 123/617; 123/643

[58] Field of Search ..... 123/613, 616, 643, 617, 123/146.5 A

[56] References Cited

U.S. PATENT DOCUMENTS

| | | | |
|---|---|---|---|
| 3,433,208 | 3/1969 | Dogadko | 123/643 |
| 3,577,971 | 5/1971 | Cavill | 123/634 |
| 3,895,612 | 7/1975 | Keely | 310/70 |
| 4,109,631 | 8/1978 | Miyao | 123/617 |
| 4,176,643 | 12/1979 | Beeghly | 123/617 |
| 4,269,152 | 5/1981 | Van Siclen | 123/643 |

*Primary Examiner*—Ronald B. Cox

*Attorney, Agent, or Firm*—Raymond J. Eifler

[57] ABSTRACT

A distributor for an ignition system that includes a plurality of optical switches (20) and a rotating member (40) having two windows (41, 42) spaced 180 degrees apart so that each switch is activated twice for each revolution of the distributor shaft. The distributor requires only as many optically coupled switches (20) as there are cylinders.

2 Claims, 4 Drawing Figures

APPARATUS FOR DISTRIBUTING ELECTRICAL SIGNALS

This invention relates to an ignition system for an internal combustion engine and more specifically to a distributor within such a system.

An ignition system for an internal combustion engine stores electrical energy, generates pulses timed to the operating cycle of the engine and distributes these pulses to switches that allow the stored electrical energy to be released and fire each spark plug in a preset order. Since the high voltage required to fire a spark plug greatly limited the life of mechanical breakers, ignition systems were developed in which switching was accomplished by electronic switches such as silicon controlled rectifiers (SCR's). Further developments also resulted in replacing conventional rotating high voltage distributors with low voltage distributors that operated on magnetic or photo electric principles. Examples of ignition systems using such switches and distributors may be found in U.S. Pat. No. 3,895,612 entitled "Light Activated Sequential Switching Mechanism" issued July 22, 1975; 4,269,152 entitled "Breakerless Pulse Distribution System An Opto-Electrical Distributor Therefor" issued May 26, 1981; and 4,176,643 entitled "Pulse Generating and Distributing Circuits for Internal Combustion Engines and the Like" issued Dec. 4, 1979.

In a four cycle engine, the engine crankshaft rotates twice for each operating cycle of the engine while in a two cycle engine, the crankshaft of the engine rotates once for each operating cycle of the engine. Normally, for a two cycle engine the distributor shaft runs at the same speed as the engine crankshaft and therefore includes only one switch for each spark plug, i.e., one revolution of the engine crankshaft equals one revolution of the distributor shaft which fires all the spark plugs. However, some engine manufacturers have produced engines that have a distributor shaft geared to runs at half the speed of the engine crankshaft. Therefore, the distributor shaft rotates only 180° for each revolution of the engine crankshaft. To accommodate this type of engine gearing in a two cycle engine, distributors were designed with twice as many switches as the number of spark plugs so that during the first half revolution of the distributor the correct number of spark plugs would be fired. Accordingly, during the second half revolution of the distributor the same spark plugs were fired again by an equal number of additional switches. In ignition systems using light activated distributors the foregoing design approach was expensive because it required two optical switches and two SCR switches for each spark plug circuit. Further, because two SCRs and two optical switches were required to be connected in parallel circuit relationship to fire the same plug, problems arose with respect to the proper firing of all plugs in the proper sequence. The foregoing problem also exists for four cycle engines wherein engine manufacturers designed engines that have a distributor shaft that runs one-fourth of the engine crankshaft speed.

DISCLOSURE OF THE INVENTION

This invention provides a distributor and ignition system that requires less switches and SCR's than previous distributors and systems. The invention is characterized by a plurality of switches arranged in a circular pattern and a rotating member having two windows spaced 180 degrees apart so that each switch may be activated twice for each revolution of the distributor shaft.

Accordingly, it is an advantage of this invention to provide a distributor that requires only as many switches as there are cylinders in an engine.

It is another advantage of this invention to provide a more efficient and less expensive optically coupled distributor for an ignition system.

It is another object of this invention to eliminate the improper firing of spark plugs associated with operating optically coupled switches and silicon controlled rectifiers in parallel.

DETAILED DESCRIPTION OF THE INVENTION

Figure 1:
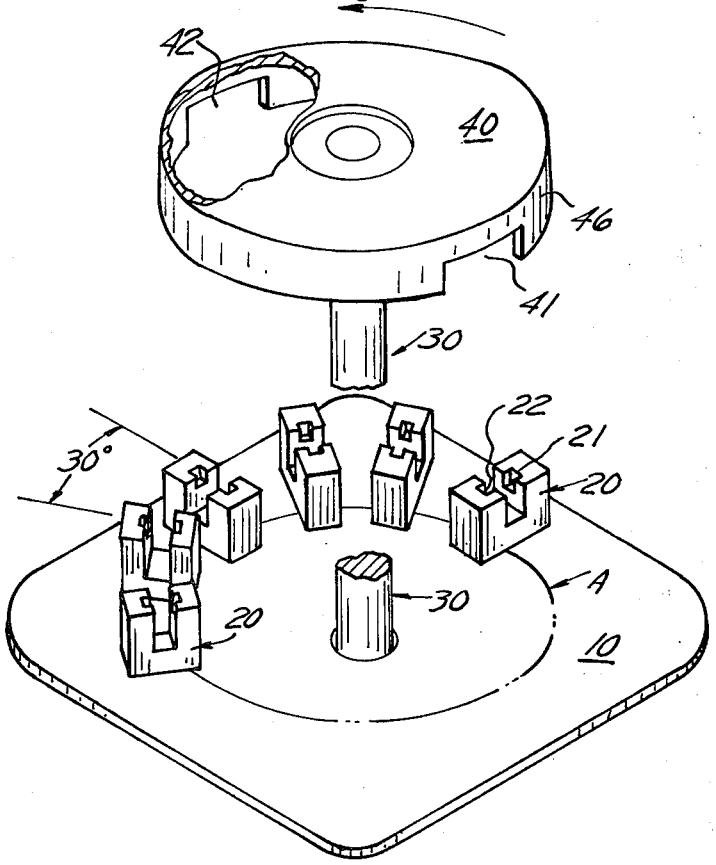
FIG. 1 illustrates an exploded view of a distributor incorporating the principles of this invention.

Referring now to the drawings, FIG. 1 illustrates a distributor for a six cylinder engine that comprises a base 10, a plurality of photoelectric switches 20, a rotatable shaft 30, and a member 40 for allowing activation of the switches 20. Each switch 20 includes a light emitting diode 21 and a light detector 22 adapted to supply an electrical signal in response to receipt of light from the diode 21. The switches 20 are arranged in a circular pattern A and are spaced 30 degrees from an adjacent switch. The member 40 includes two windows 41, 42 spaced 180 degrees apart.

Figure 2:
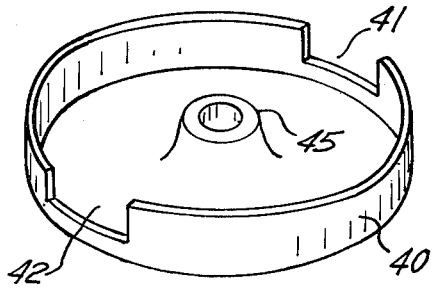
FIG. 2 is a view of a part of the distributor in FIG. 1.

FIG. 2 illustrates the underside of member 40 which has its central portion 45 mounted to the shaft 30 so that it rotates with the shaft. The member 40 includes at the outer portion thereof first and second windows 41, 42 spaced 180 degrees apart that are adapted to rotate between the diodes 21 and detectors 22.

When operating in an engine ignition system the shaft 30 is rotated by the engine crankshaft thereby rotating the member 40 and causing the windows 41 and 42 to pass between each light emitting diode 21 and detector 22. The windows 41 and 42 allow light from the diode to be transmitted to the detector and allow a signal within the ignition system, such as shown in U.S. Pat. No. 4,269,152, to be transmitted to a preselected silicon control rectifier (SCR). the SCR then turns ON allowing the electrical energy stored in a capacitor to be transmitted to a preselected spark plug.

Figure 3:
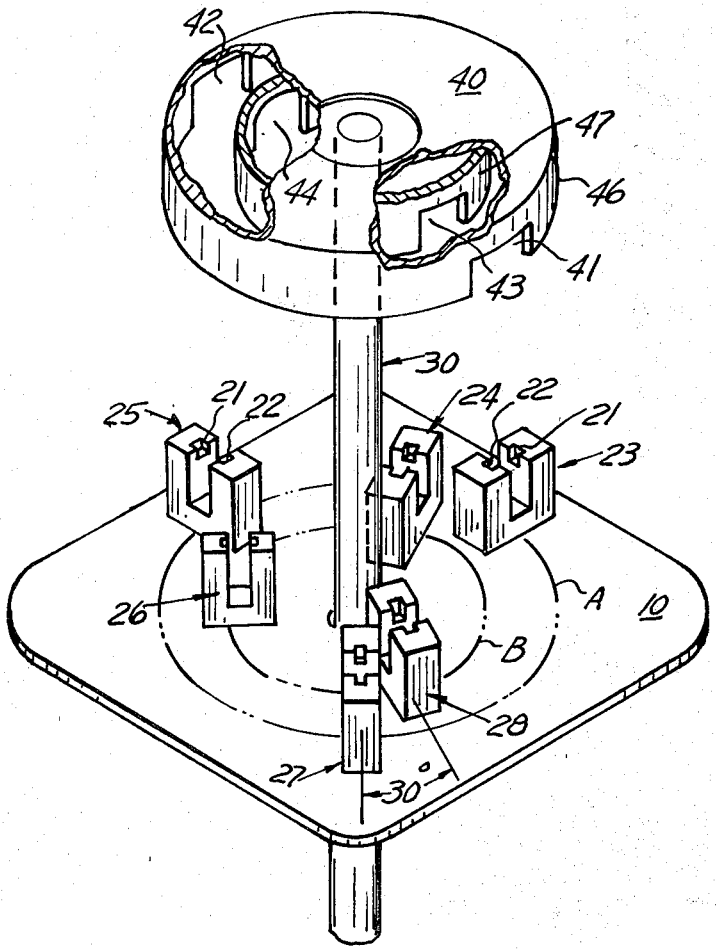
FIG. 3 is an exploded view of another embodiment of the invention.

FIG. 3 illustrates an exploded view of another embodiment of the invention that includes a base 10, a plurality of photoelectric switches 23, 25, 27, 24, 26, 28, a rotatable shaft 30 and a member 40 for allowing activation of the switches. In this embodiment switches 23, 25, and 27 are arranged in a first circular pattern A and switches 24, 26 and 28 are arranged in a second concentric circular pattern B. The switches 23, 25, and 27 are spaced 120 degrees apart from each other and switches 24, 26 and 28 are also arranged 120 degrees apart from each other. The spacing between a respective switch 27 in the first circular pattern A from an adjacent switch 28 in the second circular pattern B is 30 degrees. The inner portion 47 and outer portion 46 and their respective windows 43, 44, 41, 42 are adapted to rotate between the diodes 21 and detectors 22.

Figure 4:
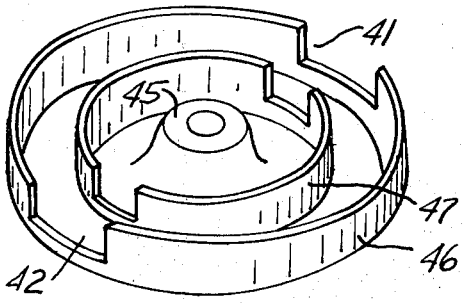
FIG. 4 is a view of a part of the distributor in FIG. 3.

FIG. 4 illustrates the underside of member 40 which has its central portion 45 mounted to the shaft 30 so that the member 40 rotates with shaft 30. The member 40 includes an outer portion 46 that extends between the diodes 21 and detectors 22 of the first plurality of switching devices 23, 25 and 27. The outer portion 46 includes the first and second windows 41 and 42 spaced 180 degrees apart. An inner portion 47 of the member 40 extends between the diodes 21 and detectors 22 of the second plurality of switching devices 24, 26 and 28 and includes first and second windows 43 and 44 spaced 180 degrees apart and radially aligned with the windows 41 and 42 of the outer portion of 46 of the member 40.

When operating in an engine ignition system the shaft 30, which is rotated by the engine crankshaft, causes the windows 41, 42, 43 amd 44 to pass between the light emitting diodes 21 and detectors 22 of the switches. For each revolution of the shaft 30 each of the switches 23, 24, 25, 26, 27 and 28 are activated twice. The outer or first plurality of switches 23, 25 and 27 are activated once by window 41 and once by window 42 for each revolution of shaft 30. Similarly, the second plurality of switches 24, 26 and 28 are activated once by window 43 and once by window 44 for each revolution of the shaft 30.

While a preferred embodiment of this invention has been disclosed, it will be apparent to those skilled in the art that changes may be made to the invention as set forth in the appended claims and, in some instances certain features of the inventions may be used to the advantage without corresponding use of other features. For instance, although six switches are shown for a six cylinder engine, for other engines there would be the same number of switches as cylinders. Further, the arrangement of the rotating member 40 and switches 20 may be such that the switches 20 are located in an upright position then, the rotating member 40 would be a flat disc that extended between the light emitting diodes 21 and detectors 22 of each switch 20. It should also be understood that the distributor may also be used with a four cycle engine and that a switch may be operated by the trigger pulse generator at any time when a window is passing a switch. Accordingly, it is intended that the illustrative and descriptive materials herein be used to illustrate the principles of the invention and not to limit the scope thereof.

Having described the invention what is claimed is:

1. An apparatus for distributing electrical signals in a predetermined sequence within an engine ignition system, said apparatus of the type having a plurality of signal means for providing output signals within said engine ignition system, said signal means including a plurality of switches arranged in a circular pattern, each of said switches comprising a light emitting diode and a light detector adapted to supply an electrical signal in response to receipt of light from said diode; and means for blocking and allowing light to pass from said diode to said detector in a predetermined sequence, the improvement wherein said blocking and allowing means comprises:

a member that extends between the light emitting diode and light detector, said member having two windows therein spaced 180 degress apart and adapted to be rotated as the crankshaft of the engine rotates, and wherein there are only as many switches as there are cylinders in the engine whereby for each revolution of said member said first and second windows allow two signals to pass between each diode and detector.

2. An apparatus for distributing signals in a predetermined sequence to an electrical circuit, said apparatus comprising:

a base;

six switching devices spaced 30 degrees apart and mounted on said base in a circular pattern, each of said switching devices comprising a light emitting diode spaced from a light detector adapted to supply an electrical signal in response to receipt of light from the diode;

a rotatable shaft mounted through said base; and a member having a central portion mounted to said shaft for rotation with said shaft and an outer portion extending between the diodes and detectors of said switching devices, said outer portion including first and second windows spaced 180 degrees apart whereby when said shaft and member rotate and a window passes between a light emitting diode and a detector the light from the diode is transmitted to the detector twice for each revolution of said shaft.

* * * * *